US011964321B2

(12) United States Patent
Furuse et al.

(10) Patent No.: US 11,964,321 B2
(45) Date of Patent: Apr. 23, 2024

(54) COILING MACHINE, METHOD FOR MANUFACTURING COIL SPRING, AND COIL SPRING

(71) Applicant: NHK SPRING CO., LTD., Yokohama (JP)

(72) Inventors: Takeshi Furuse, Yokohama (JP); Daiki Hagiwara, Yokohama (JP); Takuya Sato, Yokohama (JP); Yuichiro Yamauchi, Yokohama (JP)

(73) Assignee: NHK SPRING CO., LTD., Kanagawa (JP)

( * ) Notice: Subject to any disclaimer, the term of this patent is extended or adjusted under 35 U.S.C. 154(b) by 230 days.

(21) Appl. No.: 17/360,948

(22) Filed: Jun. 28, 2021

(65) Prior Publication Data

US 2021/0323047 A1 Oct. 21, 2021

Related U.S. Application Data

(63) Continuation of application No. PCT/JP2019/051329, filed on Dec. 26, 2019.

(30) Foreign Application Priority Data

Dec. 28, 2018 (JP) ..... 2018-246709

(51) Int. Cl.
*B21F 3/06* (2006.01)
*B21F 3/02* (2006.01)
(Continued)

(52) U.S. Cl.
CPC ..... *B21F 3/06* (2013.01); *B21F 11/005* (2013.01); *B21F 35/00* (2013.01)

(58) Field of Classification Search
CPC ..... B21F 3/02; B21F 3/04; B21F 3/06; B21F 11/005; B21F 35/00
(Continued)

(56) References Cited

U.S. PATENT DOCUMENTS 4,705,580 A 11/1987 Yamazaki
8,341,993 B2 1/2013 Eto
(Continued)

FOREIGN PATENT DOCUMENTS

CN 101534976 A 9/2009
CN 101856704 A 10/2010
(Continued)

OTHER PUBLICATIONS

English translate (JP2003010937A), retrieved date Apr. 13, 2023.*
(Continued)

*Primary Examiner* — Matthew Katcoff
*Assistant Examiner* — Mohammed S. Alawadi
(74) *Attorney, Agent, or Firm* — Holtz, Holtz & Volek PC

(57) ABSTRACT

A coiling machine includes feed rollers for moving a wire, a wire guide, a first forming roller, a second forming roller, a pitch tool, a cutting mechanism, and a support mechanism for supporting the wire. The cutting mechanism includes a cutting rotor. The wire coming out of the wire guide is formed into a helical shape by the first forming roller, the second forming roller and the pitch tool. After one coil spring of a predetermined length is formed, the wire is cut by moving the cutting rotor in the radial direction of the wire. The cutting rotor cuts the wire supported by the support mechanism in the radial direction of the wire between the second forming roller and the pitch tool.

8 Claims, 10 Drawing Sheets

(51) Int. Cl.
*B21F 3/04* (2006.01)
*B21F 11/00* (2006.01)
*B21F 35/00* (2006.01)

(58) Field of Classification Search
USPC ..... 72/135, 145, 142
See application file for complete search history.

(56) References Cited

U.S. PATENT DOCUMENTS

| | | | | |
|---|---|---|---|---|
| 8,667,825 | B2 | 3/2014 | Eto | |
| 10,022,778 | B2 | 7/2018 | Goto et al. | |
| 2008/0302156 | A1 | 12/2008 | Itaya | |
| 2010/0052231 | A1* | 3/2010 | Eto | F16F 1/047 72/142 |
| 2014/0311204 | A1 | 10/2014 | Sigg | |
| 2017/0348759 | A1 | 12/2017 | Furuse et al. | |
| 2017/0355011 | A1 | 12/2017 | Ichitsuka et al. | |
| 2018/0015529 | A1* | 1/2018 | Takahashi | B21F 3/02 |
| 2018/0071812 | A1 | 3/2018 | Furuse et al. | |

FOREIGN PATENT DOCUMENTS

| | | | | | |
|---|---|---|---|---|---|
| CN | 104107870 | A | | 10/2014 | |
| CN | 105592952 | A | | 5/2016 | |
| CN | 105922360 | A | | 9/2016 | |
| CN | 106475784 | A | | 3/2017 | |
| CN | 207255345 | U | | 4/2018 | |
| FR | 1211009 | A | | 3/1960 | |
| IN | 105377466 | A | | 3/2016 | |
| JP | S501549 | U | | 1/1975 | |
| JP | S5052687 | A | | 5/1975 | |
| JP | 86250028 | A | | 3/1987 | |
| JP | 2001239341 | A | | 9/2001 | |
| JP | 2002143962 | A | | 5/2002 | |
| JP | 2002273536 | A | | 9/2002 | |
| JP | 2003010937 | A | * | 1/2003 | |
| JP | 2003010937 | A | | 1/2003 | |
| JP | 4317252 | B2 | | 5/2009 | |
| JP | 4317252 | B2 | * | 8/2009 | B21F 3/02 |
| JP | 2016155162 | A | | 9/2016 | |
| JP | 2020032457 | A | | 3/2020 | |
| KR | 101891936 | B1 | | 8/2018 | |
| WO | 2015007496 | A1 | | 1/2015 | |
| WO | 2016208033 | A1 | | 12/2016 | |

OTHER PUBLICATIONS

English translate (JP4317252B2), retrieved date Apr. 14, 2023.*

Chinese Office Action (and English language translation thereof) dated Nov. 2, 2022, issued in counterpart Chinese Application No. 201980086627.4.

International Search Report (ISR) (and English translation thereof) dated Mar. 17, 2020 issued in International Application No. PCT/JP2019/051329.

Extended European Search Report (EESR) dated Sep. 2, 2022, issued in counterpart European Application No. 19901655.1.

Japanese Office Action (and a English language translation thereof) dated Dec. 6, 2022, issued in counterpart Japanese Application No. 2018-246709.

Chinese Office Action (and an English language translation thereof) dated Jul. 5, 2023, issued in counterpart Chinese Application No. 201980086627.4.

* cited by examiner

COILING MACHINE, METHOD FOR MANUFACTURING COIL SPRING, AND COIL SPRING

CROSS-REFERENCE TO RELATED APPLICATIONS

This application is a Continuation Application of PCT Application No. PCT/JP2019/051329, filed Dec. 26, 2019 and based upon and claiming the benefit of priority from prior Japanese Patent Application No. 2018-246709, filed Dec. 28, 2018, the entire contents of all of which are incorporated herein by reference.

BACKGROUND OF THE INVENTION

1. Field of the Invention

Embodiments of the present invention described herein relate generally to a coiling machine for manufacturing a coil spring, a method for manufacturing a coil spring, and a coil spring.

2. Description of the Related Art

As a device for manufacturing coil springs, a coiling machine including two coiling rolls is known, for example, as described in JP S62-50028 A (Patent Literature 1). In this type of coiling machine, a material (wire) for coil springs fed from a distal end of the wire guide is bent into an arc shape by the first and second coiling rolls. When a single piece of coil spring is formed, the wire is cut (sheared) by the cutter. In the case of a coil spring with a relatively small diameter, no particular problem should occur in cutting the wire with the cutter. However, when the wire has a large diameter (for example, more than φ15 mm) or when a high-hardness wire with high tensile strength is coiled in the cold process, it; is difficult to shear the wire with a conventional cutter. Moreover, the cutter and the receiving blade are easily damaged as an additional drawback.

On the other hand, as in a coil spring manufacturing device described in Patent Literature 2, cutting means using a disc-shaped grinding stone has been proposed. The cutting means are equipped with two functions: one is to cut an end turn portion of the end of a formed coil spring in the radial direction of the coil spring, and the other is to grind an end face of the end turn portion. The disk-shaped grinding stone in JP 4317252 B (Patent Literature 2) is configured to move in the radial direction of the coil spring. Here, the "radial direction of the coil spring" is a direction perpendicular to the direction in which the coil spring grows (the axial direction of the coil). When cutting an end turn portion, the coil spring is fixed by a chuck.

The disc-shaped grinding stone of Patent Literature 2 is configured to cut a wire while grinding the end face of the end turn portion. Therefore, the disc-shaped grinding stone moves in the radial direction of the coil spring (, which will be also called the coil radial direction). Here, since the amount of movement of the disc-shaped grinding stone depends on the coil diameter, such a problem, arises that it results in a great amount of movement and the time required for cutting is long. Further, since the wire is cut in the coil diameter direction, the cut area is larger than that of the circular cut surface resulting when the wire is cut in the direction of the wire diameter, and the abrasion of the disc-shaped grinding stone is also larger. Further, in order to stop the movement of the coil spring, a chuck corresponding to the coil diameter is required.

BRIEF SUMMARY OF THE INVENTION

An object of the present invention is to provide a coiling machine that can cut a helically formed coil spring in the radial direction of the wire, a method for manufacturing a coil spring, and a coil spring.

According to one embodiment, a coiling machine comprises a feed roller that moves a wire in a direction along the axis of the wire, a wire guide into which the wire is inserted, a first forming roller, a second forming roller, a pitch tool, a support mechanism, and a cutting rotor. The wire output from the wire guide is brought into contact with the first forming roller. The second forming roller is disposed on a front side of the movement direction of the wire with relative to the first forming roller. The wire is bent between the first and second forming rollers, and thus an arc portion is formed. The pitch tool is disposed on the front side of the movement direction of the wire with relative to the second forming roller. The support mechanism supports the circular arc portion of the wire when cutting the wire. The cutting rotor cuts the wire supported by the support mechanism in the radial direction of the wire between the second forming roller and the pitch tool.

According to the embodiment, a coil spring formed into a helical shape can be cut in the radial direction of the wire between the second forming roller and the pitch tool. Thus, the amount of movement of the cutting rotor is less and the time required for cutting is less as compared to the case where the wire is cut in the coil radial direction. For the support mechanism for supporting the wire during cutting, a clamping tool, a pitch tool, a second forming roller and the like can be used. When cutting the wire, the wire can be securely supported by the support mechanism.

According to one embodiment, a coil spring is consisted by a helically formed wire, and in both end (distal end and rear end) of the wire comprise a circular grinding cut surface, which is cut in the radial direction of the wire by grinding.

An example of the support mechanism includes a clamping tool disposed between the second forming roller and the pitch tool. There may be multiple clamping tools, or a single clamping tool with two separate tips. One example of the clamping tool is located on an opposite side to the wire while interposing the pitch tool therebetween. The second forming roller may have a continuous circumferential groove, and the support mechanism may include the second forming roller. A support member may be disposed inside the arc portion, and the support mechanism may include the support member.

For example, the clamping tool may include a pair of clamping arras and an adjustment member. The clamp arms clamp the wire from both radial sides of the wire. The adjustment member adjusts the distance between the clamp arms. The support mechanism may comprise a holding member with a V-shaped recess into which the wire is to be inserted. A control portion may be provided to move the cut surface of the wire away from the cutting rotor.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A coiling machine and a method of manufacturing a coil spring according to the first embodiment will be described with reference to FIGS. 1 to 6.

Figure 1:
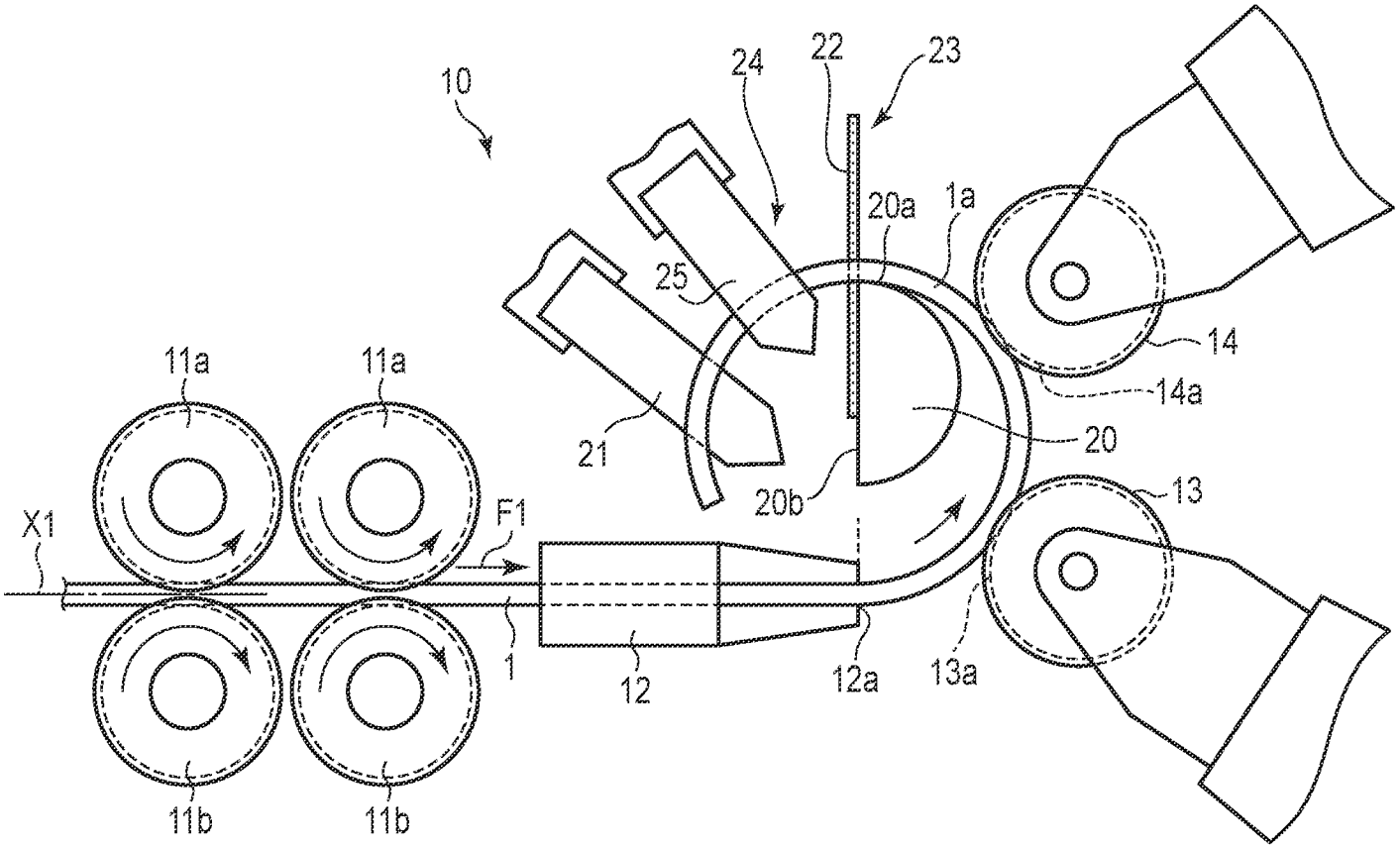
FIG. 1 is a front view schematically showing a coiling machine according to the first embodiment.

FIG. 1 schematically shows a part of a coiling machine 10. The coiling machine 10 comprises a plurality of feed rollers 11*a* and 11*b*. The feed rollers 11*a* and 11*b* move the material of a coil spring (wire 1) in the direction indicated by the arrow F1 in FIG. 1 (along an axis X1 of the wire 1). The wire 1 is made of spring steel. The steel type and size of the wire 1 are not particularly limited, for example, the tensile strength may be 1900 to 2100 MPa, or in some cases, it may exceed 2100 MPa, and the wire diameter may be more than φ15 mm.

The coiling machine 10 comprises a wire guide 12 into which the wire 1 is to be inserted, a first forming roller 13, a second forming roller 14, a support member 20 and a pitch tool 21. The wire 1 output from the distal end 12*a* of the wire guide 12 first comes in contact with the first forming roller 13. After passing through the first forming roller 13, the wire 1 comes into contact with the second forming roller 14.

The first forming roller 13 is located on a front side of the movement direction of the wire (downstream of the movement direction) relative to the distal end 12*a* of the wire guide 12. The second forming roller 14 is disposed on a front side of the movement direction of the wire 1 relative to the first forming roller 13. The wire 1 is fed out from the distal end 12*a* of the wire guide 12 toward the first forming roller 13. The wire 1 fed from the distal end 12*a* of the wire guide 12 is bent into an arc shape between the distal end 12*a* of the wire guide 12 and the first forming roller 13, with the distal end 12*a* of the wire guide 12 being substantially the starting point for bending.

After passing through the first forming roller 13, the wire 1 is further bent into an arc shape between the first and second forming rollers 13 and 14, forming an arc portion 1*a*. The arc portion 1*a* moves toward the pitch tool 21.

In an outer circumferential portion of the first forming roller 13, a groove 13*a* that is continuous in the circumferential direction is made. In an outer circumferential portion of the second forming roller 14 as well, a groove 14*a* is made, which is continuous in the circumferential direction. The first forming roller 13 and the second forming roller 14 of this embodiment each are a roller member that can rotate about an axis. In other embodiments, the first and second forming rollers may each be made of a non-rotating pin member.

The first forming roller 13 and the second forming roller 14 form the arc; portion 1*a* of the wire 1. The support member 20 is disposed on an inner side of the arc portion 1*a*. Grooves similar to the grooves 13*a* and 14*a* of the forming rollers 13 and 14 may be formed in the support member 20. As shown in FIG. 1, an inner surface of the bent portion of the arc portion 1*a* may be in contact with a contact portion 20*a* on an upper side of the support member 20. A side surface 20*b* of the support, member 20 is a plane extending along the vertical direction. The support member 20 may also be referred to as a mandrel. Depending on the specifications of the coil spring, the support member 20 may be omitted.

Figure 6:
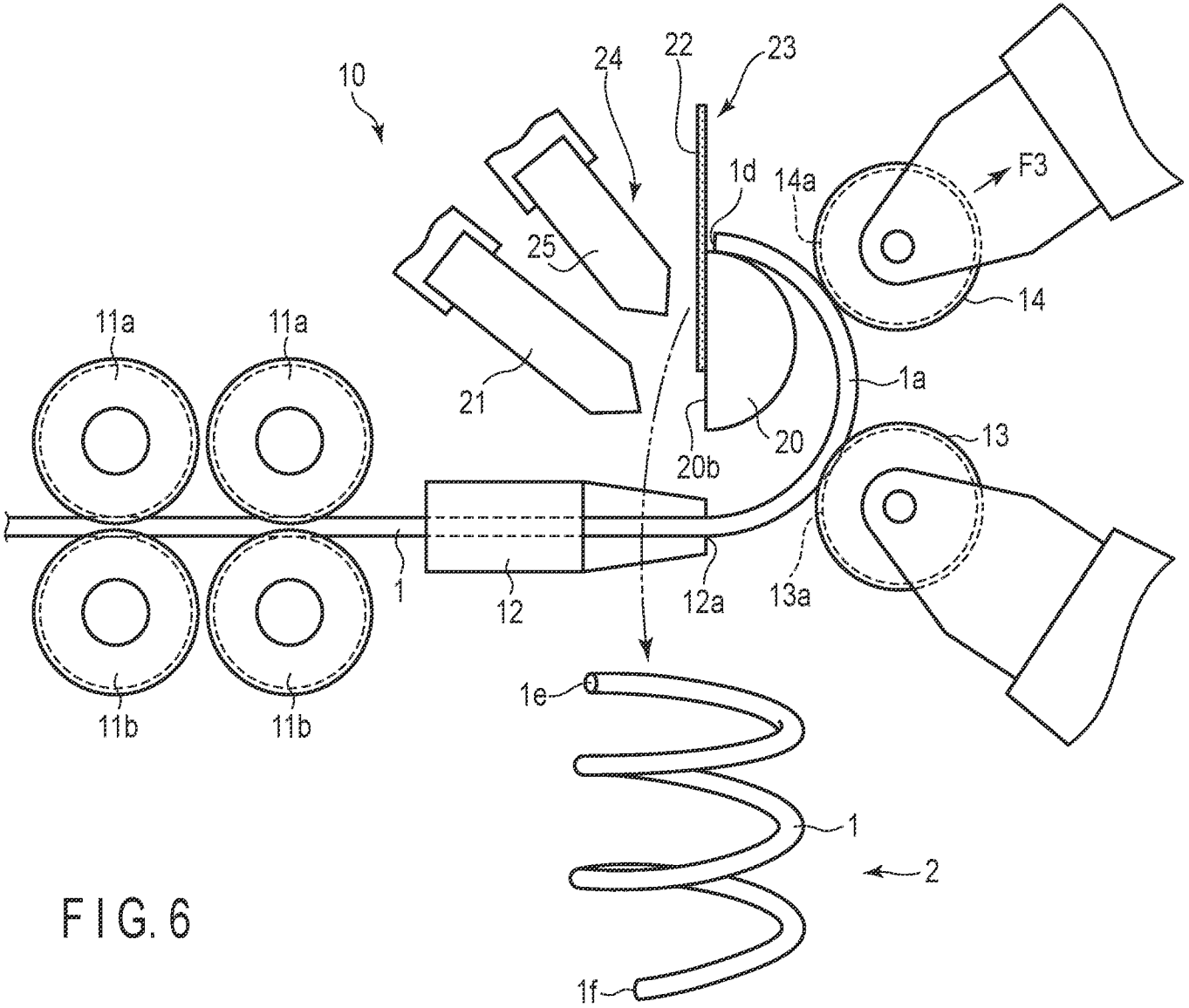
FIG. 6 is a front view showing a state where a coil spring is cut in the coiling machine.

The pitch tool 21 is located on a front side of the movement direction of the wire 1 relative to the second forming roller 14. The arc portion 1*a* of the wire 1 comes into contact with the pitch tool 21. The arc portion 1*a* of the wire 1 is pushed by the pitch tool 21 in a direction F2 (shown in FIGS. 2 and 3) in which the coil spring 2 grows. Thus, the coil spring 2 is pitched. In the manner, the wire 1 is continuously formed to produce a coil spring 2 (an example thereof is shown in FIG. 6) made of the helical-shaped wire 1.

There are various forms of coil springs. For example, the coil diameter and pitch may vary in the axial direction of the coil spring. In other words, it can be a cylindrical coil spring, a barrel-shaped coil spring, a drum-shaped coil spring, a tapered coil spring, a coil spring with unequal pitch, a coil spring with a negative pitch, etc.

The coiling machine 10 of this embodiment comprises a cutting mechanism 23 including a cutting rotor 22 and a support mechanism 24. The support mechanism 24 supports the arc portion 1*a* of the wire 1 during cutting of the wire 1. The support mechanism 24 of this embodiment includes a pitch tool 21 and a clamping tool 25. If there is a sufficient space, a cutter of the shearing method used in conventional coiling machines and the cutting mechanism 23 including the cutting rotor 22 of this embodiment may be used in combination.

Figure 2:
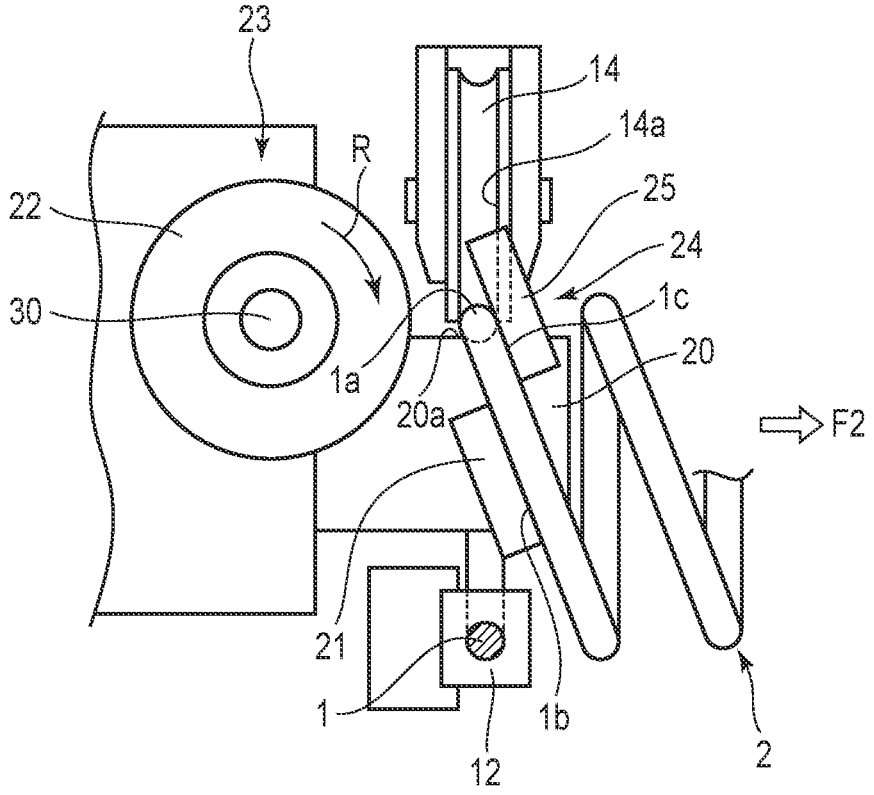
FIG. 2 is a side view of a part of the coiling machine.
Figure 3:
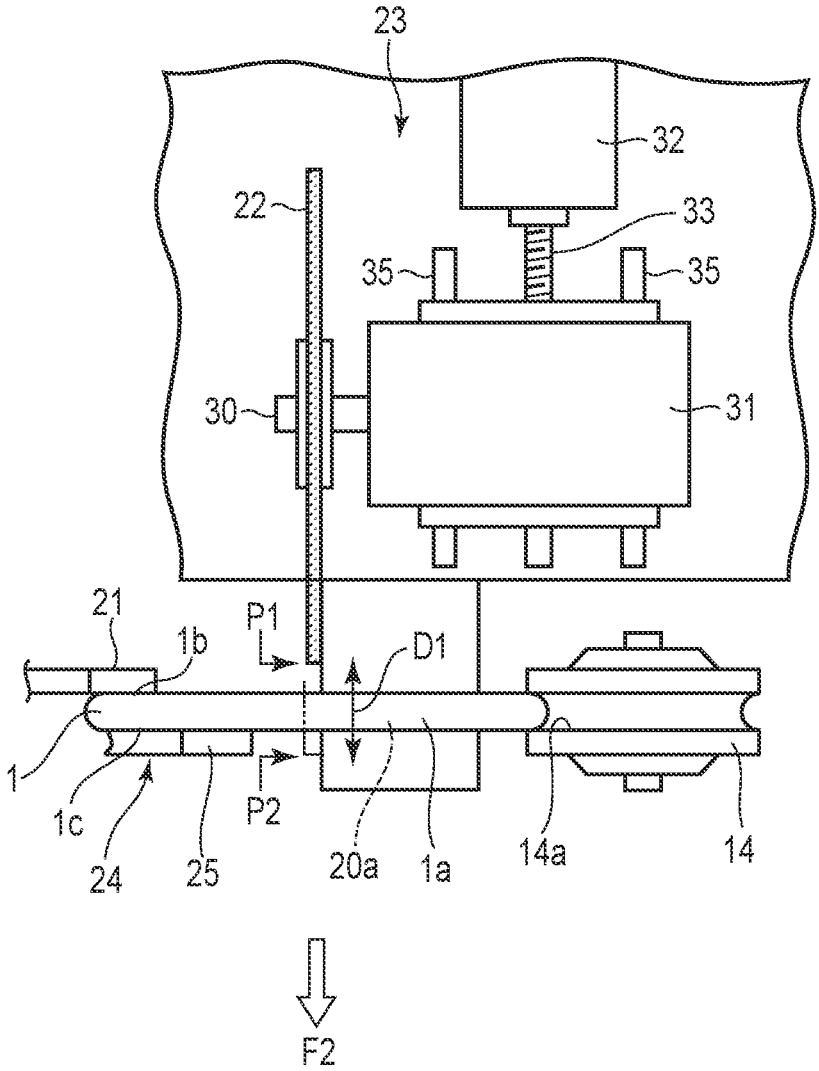
FIG. 3 is a plan view of the coiling machine.

As shown in FIGS. 2 and 3, the pitch tool 21 comes into contact with a rear surface 1*b* of the arc portion 1*a* with respect to the direction F2 in which the coil spring 2 grows. In contrast, the clamping tool 25 comes into contact with a front surface 1*c* of the arc portion 1*a* with respect to the direction F2 in which the coil spring 2 grows. In other words, the pitch tool 21 and the clamping tool 25 sandwich the front and rear surfaces 1*b* and 1*c* of the arc portion 1*a*. This support mechanism 24 prevents the arc portion 1*a* from moving in the radial direction D1 of the wire (shown in FIG. 3).

As shown in FIG. 3, a part of the arc portion 1*a* of the wire 1 is inserted into the groove 14*a* of the second forming roller 14. This prevents the wire 1 from moving in the radial direction D1 of the wire. In other words, the support mechanism 24 may include the second forming roller 14.

The arc portion 1*a* of the wire 1 is supported by the support mechanism 24. The cutting mechanism 23 cuts the arc portion 1*a* supported by the support mechanism 24 in the radial direction D1 of the wire between the second forming roller 14 and the pitch tool 21. The cutting rotor 22 can move back and forth over the standby position P1 and the cutting position P2 shown in FIG. 3.

As shown in FIG. 3, the cutting mechanism 23 includes a disk-shaped cutting rotor 22, a rotation unit 31 including a motor and an actuator 32. The cutting rotor 22 rotates around an axis 30. The rotation unit 31 rotates the cutting rotor 22. The actuator 32 moves the cutting rotor 22 to the standby position P1 and the cutting position P2. The position of the shaft 30 may be shifted upward or downward with respect to the location where the coil spring is cut. One example of the actuator 32 includes a ball screw 33. The actuator 32 moves the rotary unit 31 along the guide member 35 in the radial direction D1 of the wire. A blade portion is provided on the circumferential surface of the cutting rotor 22. The blade portion is hard enough to cut the wire 1 by grinding as in the case of a cemented carbide tip or a diamond tip.

The cutting rotor 22 rotates in the direction indicated by arrow R in FIG. 2. Note that it can also rotate in the opposite direction to arrow R. As the rotating cutting rotor 22 moves in the radial direction of the wire, the wire 1 is cut. The wire 1 is supported by the support mechanism 24 when cutting the wire 1. It is also possible to support the lower surface of the wire 1 by the contact portion 20*a* of the support member 20. In other words, the contact portion 20*a* of the support member 20 may form a part of the support mechanism 24.

Figure 4:
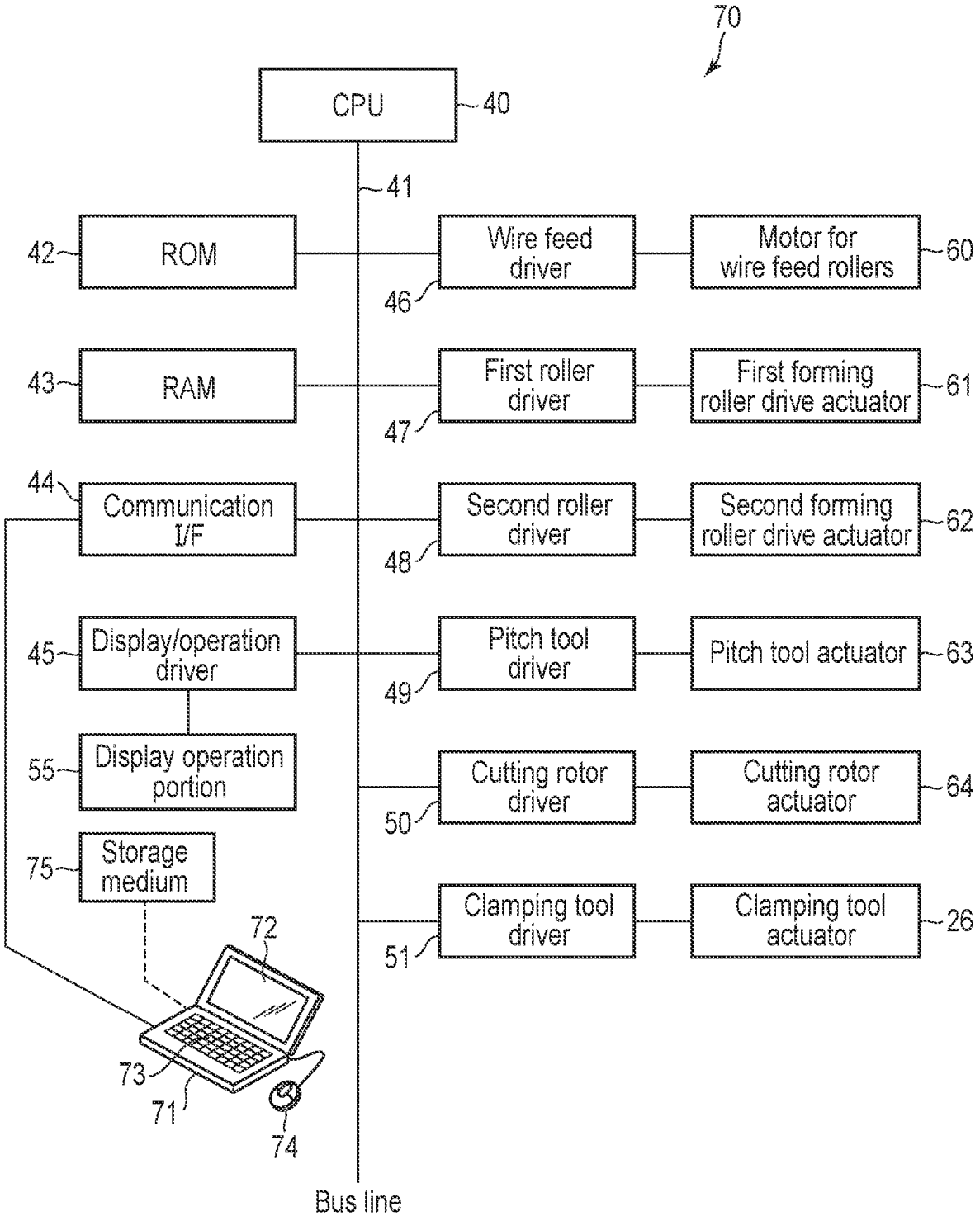
FIG. 4 is a block diagram showing an electrical configuration of the coiling machine.

FIG. 4 is a block diagram of an example of the electrical configuration of the coiling machine 10. The coiling machine 10 comprises a central processing unit (CPU) 40 which functions as a controller. To the CPU 40, connected are a read-only memory (ROM) 42, a random access memory (RAM) 43, a communication interface portion 44, a driver 45 for display/operation, a wire feeding driver 46, a driver 47 for moving the first roller, a driver 48 for moving the second roller, a pitch tool driver 49, a cutting rotor driver 50, driver 51 for moving the clamping tool, etc., are connected via a bus line 41.

The ROM 42 stores programs and various fixed data for controlling the CPU 40. The RAM 43 comprises a memory area in which various data, etc., necessary for forming coil springs are stored. The communication interface 44 controls the data communications carried out with external devices. The display/operation driver 45 controls the display operation unit 55. By operating the display/operation unit 55, the information necessary for forming coil springs can be stored in memories including the RAM 43.

The wire feeding driver 46 controls the motor 60 for rotating the feed rollers 11*a* and 11*b*. The driver 47 for moving the first roller controls the drive mechanism 61 for driving the first forming roller 13. The driver 48 for moving the second roller controls the drive mechanism 62 for driving the second forming roller 14. The pitch tool driver 49 controls the drive mechanism 63 for driving the pitch tool 21. The cutting rotor driver 50 controls the drive mechanism 64 for driving the cutting rotor 22. The driver 51 for moving the clamping tool controls the drive mechanism 65 for moving the clamping tool 25.

Thus, the electrical configuration (the control portion 70) including the CPU 40 includes a control circuit to control the rotational operation of the feed rollers 11*a* and 11*b*, a control circuit to control the positions of the first and second forming rollers 13 and 14, a control circuit to control the position of the pitch tool 21, a control circuit to control the operation of the cutting rotor 22 and the like.

The control portion 70 controls the roller drive mechanisms 61 and 62 according to the input data of the shape of the coil spring (for example, the coil diameter). For example, the roller drive mechanisms 61 and 62 are controlled so as to change the positions of the first forming roller 13 and the second forming roller 14, respectively. To the control portion 70, a personal computer 71 can be connected via the communication interface portion 44. The personal computer 71 includes a display portion 72, an input operation portion 73, a pointing device 74, a removable storage medium 75 and the like.

The process of forming a coil spring by the coiling machine 10 is automated by the CPU 40 based on a computer program stored in the control portion 70 and the shape data for control.

Figure 5:
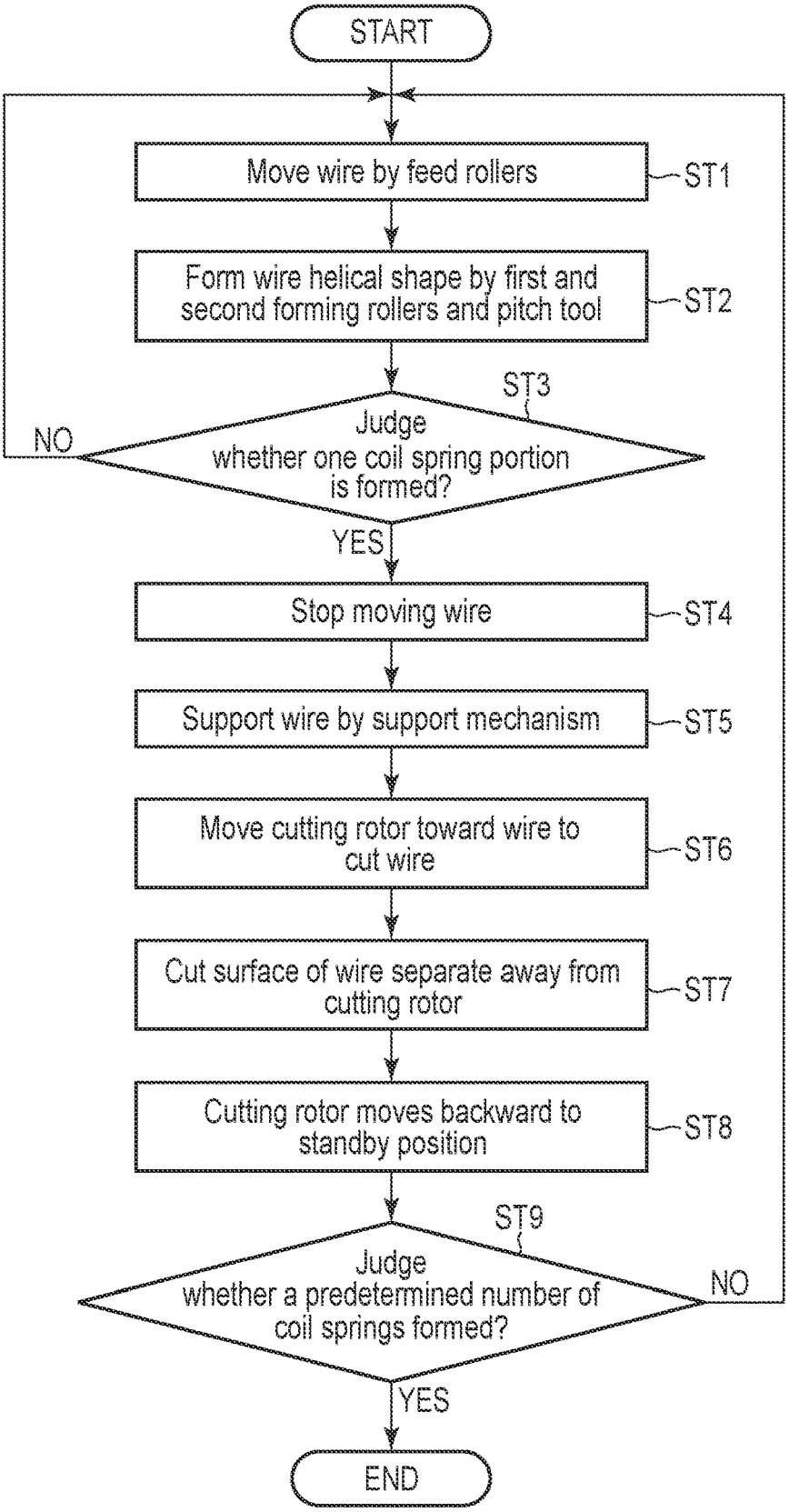
FIG. 5 is a flowchart illustrating an example of the function of a control portion of the coiling machine.

FIG. 5 is a flowchart showing some of the functions of the computer program stored in the control portion 70.

In step ST1 in FIG. 5, the wire 1 is moved by the feed rollers 11*a* and 11*b* toward the wire guide 12. After passing through the wire guide 12, the wire 1 moves toward the first forming roller 13. The temperature of the wire 1 is, for example, about the same as room temperature (cold working temperature). However, depending on the coiling conditions, it may be heated to a temperature range suitable for warm processing (for example, several hundred degrees Celsius).

In step ST2 in FIG. 5, the continuously moving wire 1 is bent into an arc shape between the first and second forming rollers 13 and 14 to form the arc portion 1*a*. Further, the arc portion 1*a* is then brought into contact with the pitch tool 21 to form a coil spring 2 made of the helical-shaped wire 1.

In step ST3, it is judged whether or not one coil spring of a predetermined length is formed. If judged as "NO" in step ST3, the process returns to step ST1 and continues forming the wire 1. If judged as "YES" in step ST3, the process proceeds to step ST4 and stops moving the wire 1.

In step ST5, the arc portion 1*a* of the wire 1 is supported by the support mechanism 24, and then the process proceeds to step ST6. In step ST6, the rotating cutting rotor 22 moves (forward) toward the wire 1. Thus, the wire 1 is cut in the radial direction of the wire by the cutting rotor 22 as shown in FIG. 6. After the wire 1 is cut, and the process proceeds to step ST7.

In step ST7, the second forming roller 14 is moved by a minute amount (about several millimeters) in the direction indicated by the arrow F3 in FIG. 6. Thus, the cut surface 1*d* of the wire 1 is separated from the cutting rotor 22 due to the elasticity of the wire 1 (spring back, etc.). At about the same time, it is recommended to control the clamping tool 25 in order to release the wire cut surface on the rear end of the coil spring 2 from the cutting rotor 22. Then, the process proceeds to step ST8.

In step ST8, the cutting rotor 22 moves (backward) to the standby position P1 (shown in FIG. 3). At this time, the cut surface 1*d* of the wire 1 (shown in FIG. 6) is separated away from the cutting rotor 22, so as to prevent the cutting surface 1*d* of the wire 1 and the cutting rotor 22 from rubbing against each other.

In step ST9, it is determined whether or not a predetermined number of coil springs have been formed. When a predetermined number of coil springs have been formed ("YES" in step ST9), the manufacturing of multiple coil springs comes to an end. If the predetermined number of coil springs have not been formed ("NO" in step ST9), the process returns to step ST1 and the forming of the next one coil spring is started.

As explained above, the manufacturing method for coil springs in this embodiment includes the following processing steps.

(1) The wire 1 is moved by the feed rollers 11*a* and 11*b* in the direction along the axis of the wire 1 toward the wire guide 12.

(2) The wire 1 coming out of the wire guide 12 is formed into a helical shape by the first forming roller 13, the second forming roller 14, and the pitch tool 21.

(3) When one coil spring of a predetermined length has been formed, the movement of the wire is stopped.

(4) The arc portion 1*a* of the wire 1 is supported by the support mechanism 24.

(5) The cutting rotor 22 is moved from the standby position toward the wire 1 (forward) in the radial direction of the wire.

(6) The wire 1 is cut in the radial direction of the wire between the second forming roller 14 and the pitch tool 21 by the rotating cutting rotor 22.

(7) The cut surface Id of the cut wire 1 is separated from the cutting rotor 22.

(8) The cutting rotor 22 is moved back to the standby position F1.

(9) Then, the movement of the wire 1 is restarted to form the next piece of coil spring.

The coiling machine 10 of this embodiment forms the wire 1 having a circular cross section into a helical shape, and cuts the wire 1 in the radial direction of the wire by the cutting mechanism 23. Thus, both ends (distal and rear ends) of the wire 1 have circular grinding cut end surfaces 1*e* and 1*f* (shown in FIG. 6), respectively, which are cut in the radial direction of the wire. The grinding cut end surfaces 1*e* and 1*f* are different from the shearing surfaces by conventional cutters. The grinding cut end surfaces 1*e* and 1*f* of this embodiment are formed by cutting the wire 1 while grinding it with the cutting rotor 22. Carbide tips and diamond tips are arranged on the circumferential surface of the cutting rotor 22. The cutting rotor 22 may as well be a grinder (grinding disk), with abrasive grains harder than the wire 1 provided around the rotor.

Figure 7:
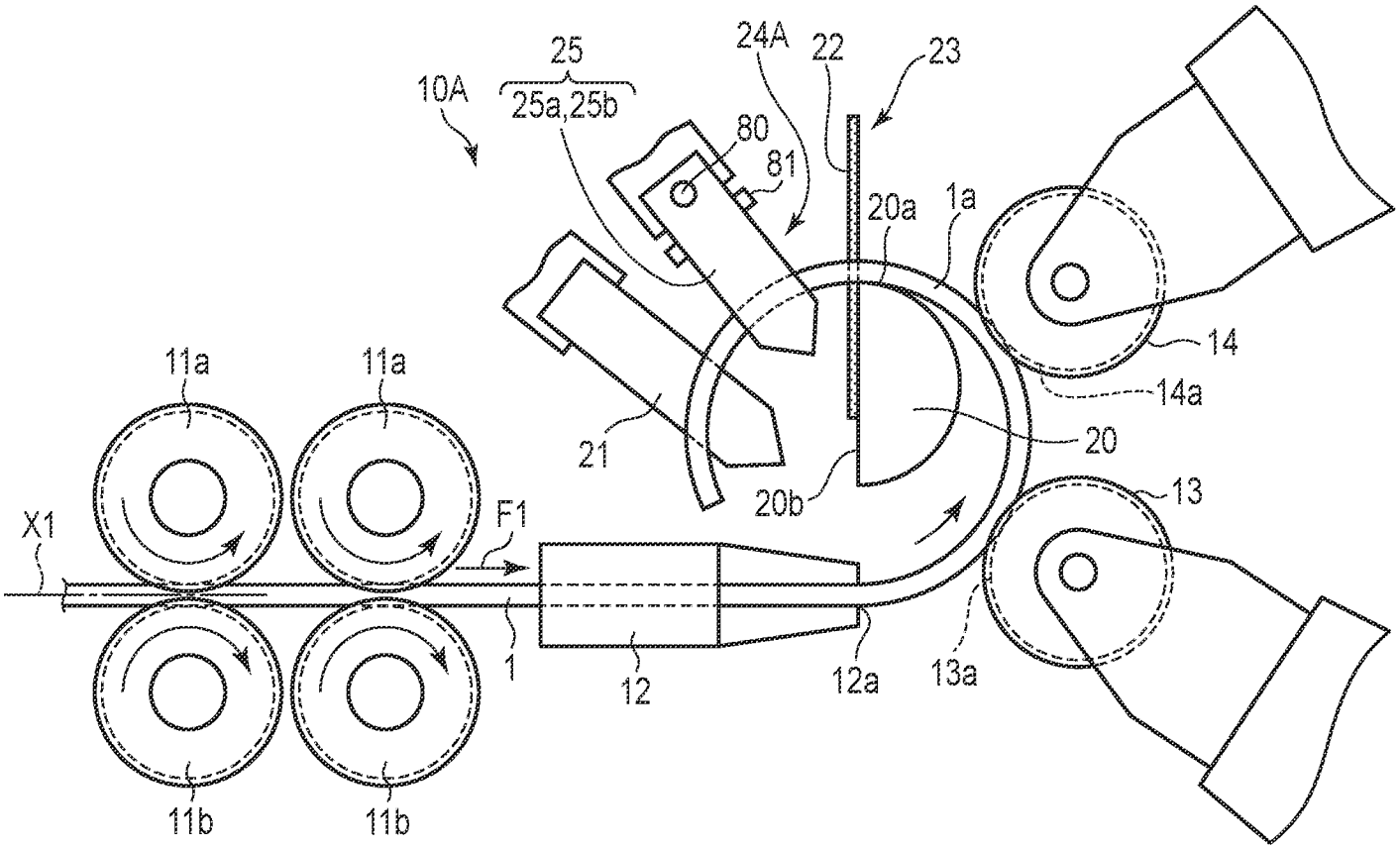
FIG. 7 is a front view schematically showing a coiling machine of the second embodiment.
Figure 8:
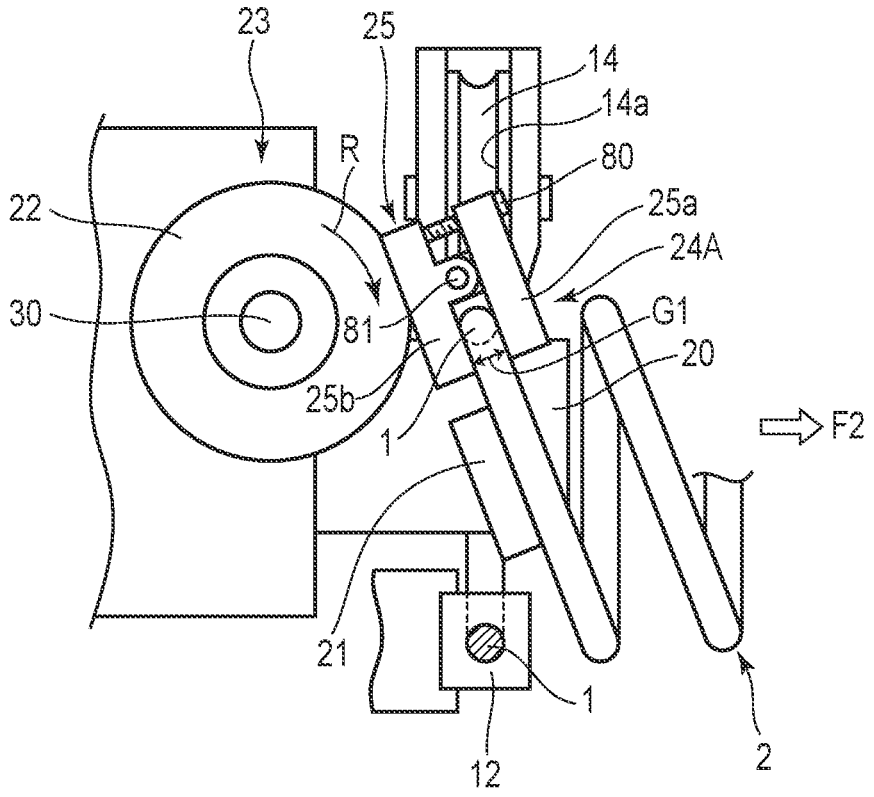
FIG. 8 is a side view of a part of the coiling machine shown in FIG. 7.

FIG. 7 shows a coiling machine 10A comprising a support mechanism 24A of the second embodiment. FIG. 8 is a plan view showing a part of the coiling machine 10A shown in FIG. 7. As shown in FIG. 8, the support mechanism 24A comprises a pair of clamp arms 25*a* and 25*b* and an adjustment member 80 such as a screw. The clamp arms 25*a* and 25*b* oppose each other with the wire 1 interposed therebetween. The adjustment member 80 adjusts a distance G1 (shown in FIG. 8) between one clamp arm 25*a* and the other clamp arm 25*b*. The clamp arms 25*a* and 25*b* can be pivoted with respect to each other around an axis 81. According to the diameter of the wire 1, the distance G1 between the clamp arms 25*a* and 25*b* can be adjusted by the adjusting member 80. The clamp arms 25*a* and 25*b* constitute the clamping tool 25.

As shown in FIG. 7, the wire 1 coming out of the wire guide 12 is formed into a helical shape by the first forming roller 13, the second forming roller 14, and the pitch tool 21. After one coil spring of the predetermined length has been formed in this way, the cutting rotor 22 moves toward the wire 1 to the cutting position.

When cutting the wire 1, the wire 1 is supported by the clamp arms 25*a* and 25*b*. Under these conditions, the wire 1 is cut by the cutting rotor 22. When cutting the wire 1, the arc portion 1*a* of the wire 1 is supported from both front and rear sides by the clamp arms 25*a* and 25*b*. Thus, it can prevent the wire from moving. As for the rest of the configuration and operation, the coiling machine 10A is common to the coiling machine 10 of the first embodiment (shown in FIGS. 1 to 6), and therefore the parts common to both are marked with common signs and the explanation thereof will be omitted.

Figure 9:
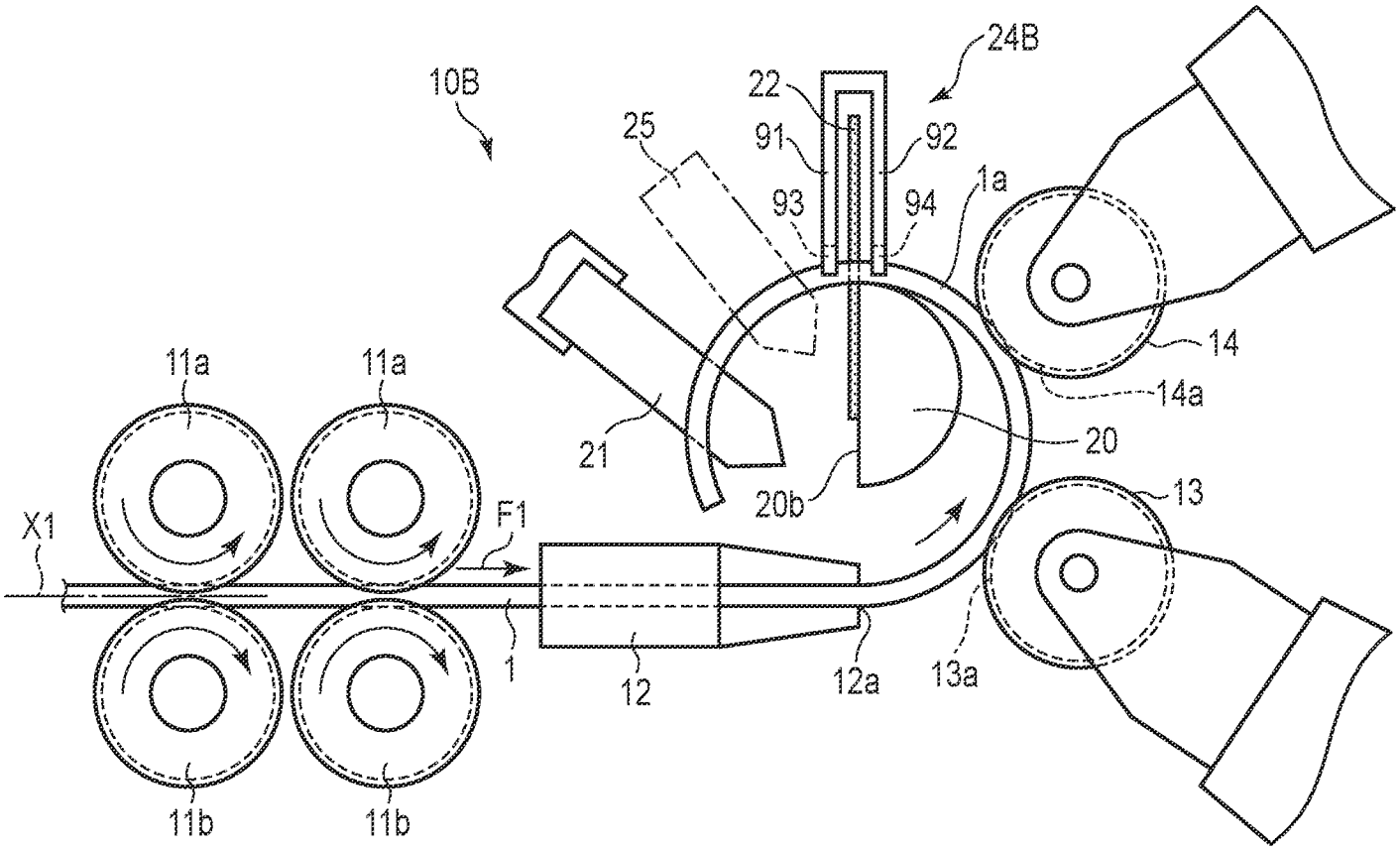
FIG. 9 is a front view schematically showing a coiling machine of the third embodiment.
Figure 10:
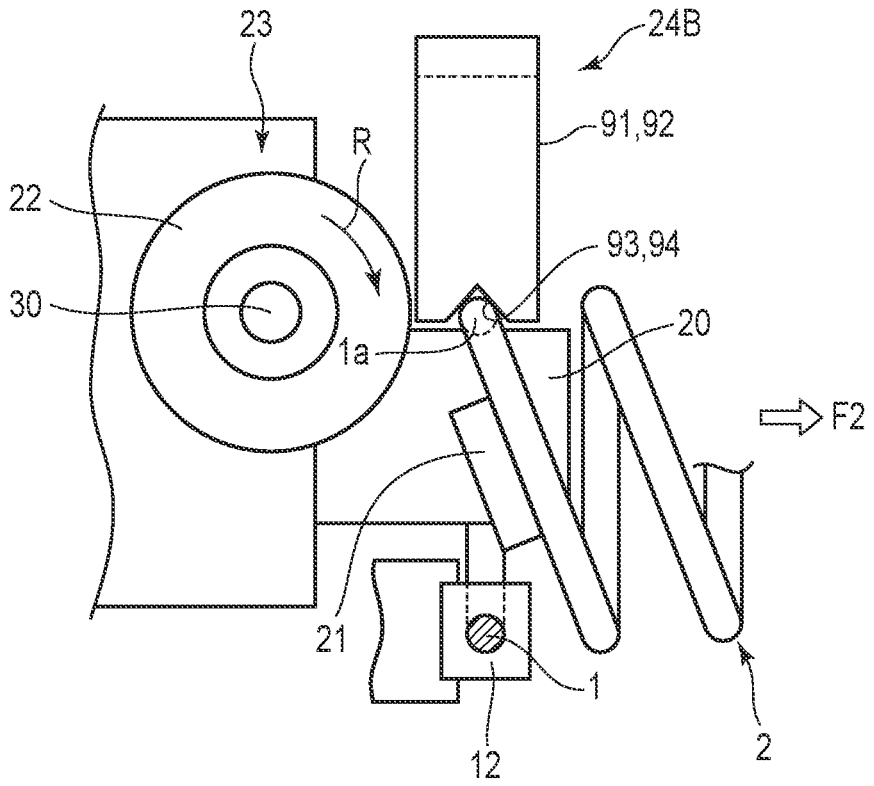
FIG. 10 is a side view of a part of the coiling machine shown in FIG. 9.

FIG. 9 shows a coiling machine 10B comprising a support mechanism 24B according to the third embodiment. FIG. 10 is a plan view showing a part of the coiling machine 10B shown in FIG. 9. As shown in FIG. 9, the support mechanism 24B comprises a pair of holding members 91 and 92 opposing each ether. The holding members 91 and 92 are disposed between the second forming roller 14 and the pitch tool 21. V-shaped recesses 93 and 94 are formed at distal ends (lower ends) of the holding members 91 and 92, respectively. As shown in FIG. 10, the arc portion 1*a* of the wire 1 is inserted into the V-shaped recesses 93 and 94.

As shown in FIG. 9, the wire 1 coming out of the wire guide 12 is formed into a helical shape by the first forming roller 13, the second forming roller 14, and the pitch tool 21. After one coil spring of the predetermined length has been formed in this way, the cutting rotor 22 moves toward the wire 1 to the cutting position. At this time, the cutting rotor 22 moves into a space between the holding members 91 and 92. Thus, it is possible to avoid the cutting rotor 22 from coming in contact with the holding members 91 and 92.

When cutting the wire 1, the wire 1 is supported by the holding members 91 and 92. Under these conditions, the wire 1 is cut by the cutting rotor 22. When cutting the wire 1, the arc portion 1*a* of the wire 1 is supported by the recesses 93 and 94 of the holding members 91 and 92. Thus, it can prevent the wire from moving. The holding members 91 and 92 of this embodiment are configured to hold the wire from above. If there is enough space, the wire 1 can be held from below.

In this embodiment of the coiling machine 10B, only the support mechanism 24B may be used as a means for supporting the wire 1. Or, a clamping tool 25 may be used in combination, as indicated by a double-dotted line in FIG. 9. As to the rest of the configuration and operation, the coiling machine 10B is common to the coiling machine 10 of the first embodiment, (shown in FIGS. 1 to 6), and therefore the parts common to both are marked with common signs and the explanation thereof will be omitted.

The present invention can be applied to various types of coil springs. Further, it is needless to say that the configuration and arrangement of the elements constituting the coiling machine, including the feed roller, wire guide, first and second forming rollers, pitch tool, support mechanism, and cutting rotor, can be changed in various ways as necessary to implement the present invention.

Additional advantages and modifications will readily occur, to those skilled in the art. Therefore, the invention in its broader aspects is not limited to the specific details and representative embodiments shown and described herein. Accordingly/various modifications may be made without departing from the spirit or scope of the general inventive concept as defined by the appended claims and their equivalents.

What is claimed is:

1. A coiling machine comprising:

feed rollers to move a wire;

a wire guide into which the wire is inserted;

a first forming roller with which the wire coming out of the wire guide comes into contact;

a second forming roller disposed on a front side of a movement direction of the wire with respect to the first forming roller, which forms an arc portion by bending the wire between the first forming roller and the second forming roller;

a support mechanism which supports the arc portion of the wire, wherein the support mechanism comprises:

a pitch tool disposed on a front side of the movement direction of the wire with respect to the second forming roller and brought into contact with one surface of the arc portion of the wire, the pitch tool pushing the one surface of the arc portion toward a direction in which a coil spring grows; and a clamping tool disposed between the second forming roller and the pitch tool, the arc portion of the wire being sandwiched between the clamping tool and the pitch tool in a radial direction of the wire, wherein the support mechanism prevents the arc portion from moving in the radial direction of the wire; and a cutting rotor which cuts the wire supported by the support mechanism in the radial direction of the wire between the second forming roller and the pitch tool.

2. The coiling machine according to claim 1, wherein:

the pitch tool faces a first side of the wire in the radial direction of the wire, and the clamping tool faces a second side of the wire in the radial direction of the wire.

3. The coiling machine according to claim 1, wherein:

the second forming roller comprises a groove continuous in a circumferential direction, and the support mechanism includes the second forming roller.

4. The coiling machine according to claim 1, wherein the support mechanism comprises a support member disposed on an inner side of the arc portion.

5. The coiling machine according to claim 1, wherein the clamping tool comprises a pair of clamping arms which clamp the wire from both sides of the wire in the radial direction, and an adjustment member which adjusts a distance between the clamping arms.

6. The coiling machine according to claim 1, wherein the support mechanism comprises holding members with V-shaped recesses into which the wire is inserted.

7. The coiling machine according to claim 1, further comprising:

a control portion which moves a cut surface of the wire away from the cutting rotor.

8. A method of manufacturing a coil spring, comprising:

moving a wire toward a wire guide by feed rollers;

forming the wire coming out of the wire guide into a helical shape which includes an arc portion by a first forming roller, a second forming roller and a pitch tool;

stopping the moving of the wire when one coil spring of a predetermined length is formed;

supporting the arc portion in a radial direction of the wire by a support mechanism which includes a clamping tool and the pitch tool;

moving a cutting rotor in the radial direction of the wire from a standby position toward the wire;

cutting the wire in the radial direction of the wire between the second forming roller and the pitch tool by the rotating cutting rotor;

moving the second forming roller in a direction away from the cutting rotor such that a cut surface of the wire is separated from the cutting rotor due to elasticity of the wire; and moving back the cutting rotor toward the standby position.

* * * * *